US010794119B2

(12) United States Patent
Smith et al.

(10) Patent No.: US 10,794,119 B2
(45) Date of Patent: Oct. 6, 2020

(54) ROTARY DOWNHOLE TOOL

(71) Applicant: NOV Downhole Eurasia Limited, Stonehouse, Gloucestershire (GB)

(72) Inventors: Haydn G. Smith, Dursley (GB); Graham Watson, Gloucester (GB)

(73) Assignee: NOV Downhole Eurasia Limited, Stonehouse, Gloucestershi (GB)

( * ) Notice: Subject to any disclaimer, the term of this patent is extended or adjusted under 35 U.S.C. 154(b) by 62 days.

(21) Appl. No.: 15/548,456

(22) PCT Filed: Jan. 28, 2016

(86) PCT No.: PCT/GB2016/050189
§ 371 (c)(1),
(2) Date: Aug. 3, 2017

(87) PCT Pub. No.: WO2016/124890
PCT Pub. Date: Aug. 11, 2016

(65) Prior Publication Data

US 2018/0238117 A1 Aug. 23, 2018

(30) Foreign Application Priority Data

Feb. 4, 2015 (GB) ..... 1501823.7

(51) Int. Cl.

| | |
|---|---|
| ***E21B 10/30*** | (2006.01) |
| ***E21B 17/10*** | (2006.01) |
| ***E21B 17/16*** | (2006.01) |
| ***E21B 12/00*** | (2006.01) |
| ***E21B 7/06*** | (2006.01) |
| ***E21B 10/42*** | (2006.01) |
| *E21B 10/55* | (2006.01) |

(52) U.S. Cl.
CPC ..... *E21B 12/00* (2013.01); *E21B 7/064* (2013.01); *E21B 10/30* (2013.01); *E21B 10/42* (2013.01); *E21B 17/1092* (2013.01); *E21B 10/55* (2013.01)

(58) Field of Classification Search
CPC ..... E21B 10/30; E21B 17/10; E21B 17/1078; E21B 17/1057; E21B 17/16; E21B 17/1092
See application file for complete search history.

(56) References Cited

U.S. PATENT DOCUMENTS

| | | | |
|---|---|---|---|
| 874,848 | A | 12/1907 | Karns |
| 1,577,810 | A | 3/1926 | Raymond |
| 3,303,900 | A | 2/1967 | Kloesel et al. |

(Continued)

FOREIGN PATENT DOCUMENTS

| | | | |
|---|---|---|---|
| GB | 2454361 | | 5/2009 |
| GB | 2462813 | A | 2/2010 |

(Continued)

OTHER PUBLICATIONS

UK Search Report for GB 1501823.7 dated Apr. 14, 2015.

(Continued)

*Primary Examiner* — Cathleen R Hutchins
(74) *Attorney, Agent, or Firm* — Andrus Intellectual Property Law, LLP

(57) ABSTRACT

A rotary downhole tool, for example in the form of a drill bit, is described that includes a tool body, the body defining a gauge region, and at least one gauge roller rotatably mounted to the body.

26 Claims, 2 Drawing Sheets

(56) References Cited

U.S. PATENT DOCUMENTS

| | | | | | |
|---|---|---|---|---|---|
| 3,429,390 | A | | 2/1969 | Bennett | |
| 3,820,613 | A | * | 6/1974 | White | E21B 10/23 175/337 |
| 3,977,481 | A | * | 8/1976 | Fisk | E21B 10/52 175/228 |
| 4,428,626 | A | * | 1/1984 | Blau | E21B 17/1078 175/325.4 |
| 5,109,935 | A | | 5/1992 | Hawke | |
| 5,339,910 | A | | 8/1994 | Mueller | |
| 5,649,603 | A | * | 7/1997 | Simpson | E21B 4/18 166/241.3 |
| 5,697,461 | A | | 12/1997 | Newton et al. | |
| 7,036,612 | B1 | * | 5/2006 | Raymond | E21B 17/07 175/320 |
| 2010/0252327 | A1 | | 10/2010 | Beuershausen et al. | |
| 2012/0255744 | A1 | | 10/2012 | Shaikh et al. | |
| 2013/0133954 | A1 | | 5/2013 | Mohon et al. | |

FOREIGN PATENT DOCUMENTS

| | | | | | |
|---|---|---|---|---|---|
| SU | 287856 | A1 | | 12/1970 | |
| WO | 2014018040 | A1 | | 1/2014 | |
| WO | 2015005907 | A1 | | 1/2015 | |
| WO | WO2015/005907 | | * | 1/2015 | E21B 17/10 |

OTHER PUBLICATIONS

International Search Report and Written Opinion for International Patent Application No. PCT/GB2016/050189 dated Apr. 25, 2016.
Official Notification for Russian Patent Application No. 2017130903 dated May 15, 2019.

* cited by examiner

ROTARY DOWNHOLE TOOL

CROSS-REFERENCE TO RELATED APPLICATIONS

This application is the U.S. national stage application of International Application PCT/GB2016/050189 filed Jan. 28, 2016, which international application was published on Aug. 11, 2016, as International Publication WO 2016/124890 in the English language. The International Application claims priority of United Kingdom Patent Application 1501823.7, filed Feb. 4, 2015.

BACKGROUND

This invention relates to a rotary downhole tool such as a drill bit, and in particular to a tool used in the drilling of boreholes in earthen formations.

The drilling of boreholes in earthen formations typically involves the use of a number of downhole tools that rotate, in use, for example, drill bits, stabilisers, sensor housings and other devices.

A number of types of drill bit are known. One form of drill bit is a fixed cutter drill bit comprising a rigid bit body upon which a number of cutters or cutting elements are mounted. By way of example, the bit body may include a series of upstanding blades upon which the cutters are mounted. In use, the drill bit is driven for rotation about an axis thereof whilst a weight on bit loading is applied thereto with the result that the cutters gouge or cut into, or otherwise abrade, the earthen formation with which they are in engagement, drilling or extending a borehole therein. A drilling fluid or mud may be pumped to the drill bit, serving to clean and cool the cutters and to carry away materials cut by the cutters.

Parts of the drill bit define a gauge region. Typically, the gauge region is of generally cylindrical form, although grooves or slots may extend through the gauge region in some drill bit designs. The gauge region typically bears against the surface of the borehole, in use, and the contact between the wellbore wall and the gauge region may cause wear on the drill bit, and further serves to resist rotation of the drill bit. The contact between the gauge region and the wall of the borehole serves to stabilise the bit, resisting undesired tilting or the like thereof.

U.S. Pat. Nos. 5,109,935 and 5,339,910 describe drill bits in which generally cylindrical rotatable elements are located at the gauge region, the rotatable elements bearing against the wall of the borehole, in use, and being rotatable relative to the body of the associated drill bit. The use of such rotatable elements in the gauge region serves to reduce wear and reduce the resistance to rotation of the drill bit.

Whilst the use of such rotatable elements may result in a reduction in wear and resistance to rotation, there is a risk that the stability of the drill bit may be reduced.

Whilst the discussion hereinbefore relates primarily to drill bits, it will be appreciated that other rotary downhole tools will include a gauge region that bears, in use, against the wall of the borehole, and so will experience corresponding loadings, in use, and will be subject to wear.

SUMMARY

According to the present invention there is provided a downhole rotary tool comprising a tool body defining a gauge region, and at least one gauge roller rotatably mounted to the body.

The tool may comprise a drill bit, the body comprising a bit body upon which a plurality of cutting elements are mounted. Alternatively, the tool may comprise a stabiliser or other downhole tool.

The gauge region preferably further includes at least one fixed gauge pad able to bear, in use, against the wall of a borehole. As a result, stability of the drill bit or other tool, in use, may be enhanced.

The at least one gauge roller is conveniently removable to allow replacement thereof. As a result, the working life of the tool may be extended.

The number of gauge rollers can conveniently be varied or adjusted. It will be appreciated that such adjustment permits a balance to be struck between the stability of the bit and wear of the tool.

Conveniently, the fixed gauge pads are removably mounted to the body. The manner in which the fixed gauge pads and gauge rollers are mounted to the body is conveniently such that the fixed gauge pads and gauge rollers can be interchanged with one another.

The at least one gauge roller has an axis of rotation which, conveniently, is angled to the axis of rotation of the tool, in use. The axis of rotation of the at least one gauge roller may be, for example, angled perpendicularly to the axis of rotation of the tool. Such an arrangement may assist in running of the tool into or out of the borehole. Alternatively, the angling of the axis may be used to enhance support when the tool is tilted relative to the axis of the adjacent part of the borehole, for example by tilting the axes of rotation of the gauge rollers such that they lie upon the surface of a notional cone.

The at least one gauge roller may incorporate a ratchet whereby rotation of the gauge roller in one rotary direction is permitted, but rotation in the reverse direction is resisted. Such an arrangement is thought to reduce whirl and stick-slip motions of the tool that are known to result in reverse rotation and/or significant rotational speed variations of the tool.

A damping arrangement may be provided to resist acceleration of the gauge roller and/or to limit the speed of rotation thereof, which may serve to reduce stick slip issues.

BRIEF DESCRIPTION OF THE DRAWINGS

The invention will further be described, by way of example, with reference to the accompanying drawings, in which.

DETAILED DESCRIPTION OF THE DRAWINGS

Figure 1:
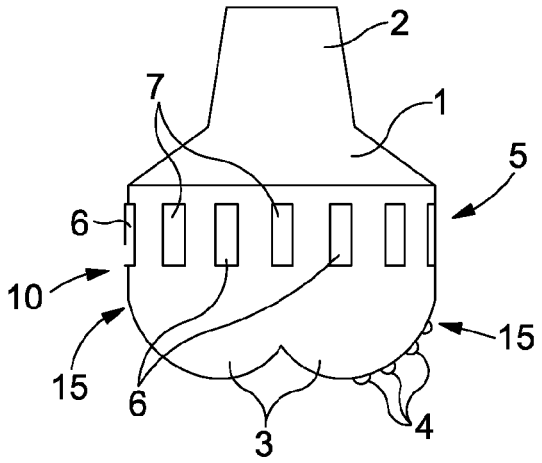
FIG. 1 illustrates a drill bit in accordance with one embodiment of the invention.

Referring firstly to FIG. 1, a fixed cutter drill bit 10 is shown, diagrammatically, comprising a bit body 1 with a tapering portion 2 for connection to a drill string (not shown) at an upper end of the drill bit 10. At the lower end of the drill bit 10 there is provided a plurality of cutting blades 3, each of which carries a plurality of fixed cutting elements 4.

Each cutting element 4 is substantially cylindrical, and comprises a polycrystalline diamond compact (PDC) table, bonded to a cemented carbide substrate. There are, for example, six blades 3, equally spaced around the circumference of the drill bit 10. Each blade 3 extends in a curved path from the centre of rotation of the bit, to the outer edge of the drill bit 10, and each blade 3 includes a portion 15 that is substantially parallel to the rotational axis of the bit 10. Between each blade there is a recessed portion (not shown), which allows chips and drilling mud to clear from the drill bit 10, being carried away there from by a flow of drilling fluid or mud. Drill bits of this general form are well known and so only the differences between a typical drill bit and a bit in accordance with an embodiment of the invention will be described herein.

Rearward of the blades 3 there is a gauge section 5. The gauge section is made up of a plurality of gauge rollers 6 and a series of fixed gauge pads 7. The rollers 6 are mounted in such a manner as to be free to rotate relative to the bit body, and serve to reduce friction between the drill bit and the borehole. The fixed gauge pads 7 are mounted in such a manner that the gauge surfaces thereof are fixed relative to the bit body 1. They bear, in use, against the adjacent wall of the borehole and serve to enhance the stability of the bit.

Figure 2A:
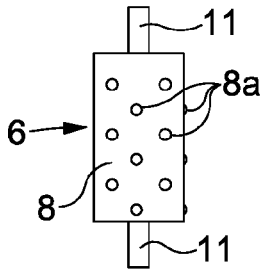
FIGS. 2*a*, 2*b* and 2*c* are views illustrating parts of the bit of FIG. 1.

FIG. 2*a* shows a gauge roller 6 separate from the bit 10. Each roller 6 comprises a carrier 11, on which is carried a roller element 8 which is substantially cylindrical and rotatable relative to the carrier 11 about the axis of the roller element 8. The roller element 8 is conveniently provided with a series of relatively hard, wear resistant engagement features 8*a*. The rotation of the roller element 8, in use, helps to reduce friction between the gauge portion of the drill bit 10 and the borehole.

An internal bearing (not shown) is provided between the roller element 8 and the carrier 11. The internal bearing may be similar to those employed in roller cutters. The internal bearing may comprise a diamond coated surface on at least one of the internal face of the roller element 8 and the bearing face of the carrier 11. The internal bearing may be provided with dynamic seals, thereby retaining lubricant within the bearing. Alternatively, the internal bearing may be lubricated by circulating drilling mud. In alternative embodiments the internal bearing may comprise roller bearings, for example needle roller bearings and/or taper roller bearings. A thrust bearing may be provided to react axial loads on the roller element 8. The thrust bearing may comprise two rubbing polycrystalline surfaces. The presence of the fixed gauge pads 7 may serve to reduce the side loadings to which the rollers are exposed, in use, preventing or reducing the risk of catastrophic failure of the roller or bit in the event of a bearing failure.

Figure 2B:
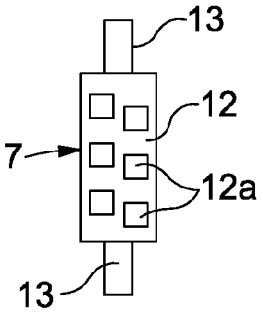

The fixed gauge pads 7 each comprise a body 12 (see FIG. 2*b*) upon which a plurality of wear resistant engagement features 12*a* are provided. A carrier 13 extends from the body 12.

Figure 2C:
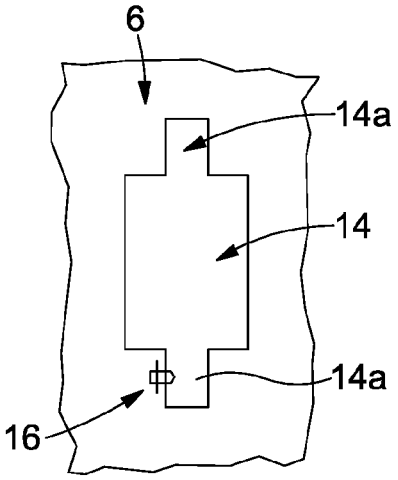

The carriers 11, 13 are releasably mountable to the bit body 1 so releasably secure the fixed gauge pads 7 and gauge rollers 6 to the bit body 1. The gauge region 5 is thus formed with a series of recesses or pockets 14 (see FIG. 2*c*) of dimensions sufficient to permit the gauge rollers 6 or pads 7 to be received therein, with part of the circumference of the gauge roller 6 or the gauge surface of the gauge pad 7 protruding from the pocket 14. Each pocket 14 includes a pair of extensions 14*a* arranged to receive the carriers 11, 13. Fixing means 16, for example in the form of a grub screw or the like, are used to secure the carriers 11, 13 in position and thereby secure the rollers 6 and pads 7 against movement.

The drill bit 10 is configured so that when the rollers 6 are mounted to the bit 10, the axis of each roller element 8 is substantially parallel to the rotational axis of the drill bit 10. There are, for example, six rollers 6, and each roller 6 is positioned adjacent to a corresponding blade 3. Each roller 6 is mounted in the same axial position on the drill bit 10. The rollers 6 may alternate with the pads 7, but this need not always be the case.

Each roller element 8 is provided, as mentioned above, with a plurality of dome shaped engagement features 8*a*. The features 8*a* comprise, for example, a hard, abrasion resistant material such as polycrystalline diamond. In other embodiments the roller element 8 may be formed without any such features 8*a*, and may instead have thermally stable polycrystalline diamond elements, hardfacing or a diamond coating applied thereto. The nature of the external surface of the roller element 8 may be tailored to suit the purpose of the roller 6.

In the present embodiment, the spacing between the features 8*a* of each roller element 8 is relatively large, and their geometry is such that the effective radius of each roller 6 changes as the roller element 8 rotates. The roller gauge therefore continually varies, and this may cause unacceptable or undesirable vibrations. The fixed gauge pads 7 and their cooperation with the borehole wall may serve to stabilise the bit and reduce such vibrations. It may be desirable to eliminate this variation, and the roller element 8 may have a smooth outer surface, or may include a greater number of features 8*a* to smooth out this variation. Alternatively the outer surface may have a constant effective radius without being smooth, for example having circumferential or helical grooves, or knurling. In a further alternative, the features 8*a* may be arranged such that the difference in effective radius as the roller element rotates is less than 0.5 mm.

In use, the drill bit is rotated about its axis whilst a weight on bit loading is applied thereto. As a result, the cutting elements 4 dig into and gouge, scrape, abrade or otherwise remove material from the end part of a borehole being drilled. The gauge region 5 bears against the surface of the borehole, providing support for the bit body resisting tilting thereof. It will be appreciated that the engagement of the gauge region 5 with the wall of the borehole increases the frictional resistance to rotation of the drill bit, and increases wear of the drill bit. By providing the drill bit gauge region 5 with a series of gauge rollers 6, it will be appreciated that the resistance to rotation of the drill bit is reduced, and wear is also reduced. However, the stability of the drill bit may also be reduced compared to an arrangement in which the gauge region does not include rollers. In order to strike a desired balance between frictional resistance and wear, and stability, the number of gauge rollers 6 may be varied by removing gauge rollers 6 and substituting them with fixed gauge pads 7, or by removing fixed gauge pads 7 and replacing them with rollers 6.

In the present embodiment, the rollers 6 are mounted so that the gauge portion 5 has a radius equal to that of the hole cut by the cutting elements 4 of the blades 3. In other embodiments the rollers 6 may be arranged so that the gauge portion 5 has a radius that is greater than the radius of the hole cut by the bit 10, so that the rollers 6 exert a centralizing force on the bit 10 when in the hole.

In other embodiments, one or more of the rollers 6 and/or fixed gauge pads 7 may be retained by a mounting arrangement that has some flexibility, thereby providing a degree of radial cushioning. For example, a mounting arrangement may be used that is sprung loaded, and which provides a radial force in response to radial displacement of the roller 6 or pad 7. Such an arrangement may be pre-loaded so that a threshold force is necessary for the roller 6 or pad 7 to move radially inward. The mounting arrangement may be such that radial movement of the roller 6 or pad 7 is damped.

In some embodiments, the mounting arrangement may be such that the position of a roller 6 and/or pad 7 relative to the bit body 1 is adjustable. The position of the roller 6 or pad 7 may be adjustable between fixed positions, or may be continuously variable. Such variable mounting arrangements may vary the radial position of the rollers 6 or pads 7, and may for instance be used to overcome the increased risk of bit whirl as the bit wears by increasing the amount of centralizing force from the roller gauge. Such an adjustable mounting arrangement may use hydraulic pressure, springs, weight on bit, torque on bit, a dropped ball and/or a "j" latch arrangement to vary the mounting arrangement.

An adjustable mounting arrangement may be provided at a single end of the roller 6 or pad 7, with the other end being pivotally mounted to the bit body 1, so that the adjustment means is operable to vary the angle of the roller 6 or orientation of the pad 7, causing tilting thereof. The roller 6 or pad 7 can thereby be angled for maximum contact with the borehole.

In some embodiments, the rollers 6 and/or pads 7 could be configured for bit steering and/or directional drilling behaviour. This may be achieved either by a pre-set configuration of rollers 6 and/or pads 7, or by changing the configuration of rollers 6 and/or pads 7 during the drilling process. For example, the position, attitude or rolling resistance of one or more rollers 6 may be changed to provide a bias/out of balance force on the drill bit 10. These types of changes may be pre-determined, and the rollers 6 or pads 7 configured to be switchable between a first configuration with a first directional drilling behaviour, and a second configuration with a second, different directional drilling behaviour. The switch between configurations may require a pause in drilling, or may be adjusted while drilling.

Whilst in the arrangement described hereinbefore a roller 6 is aligned with each blade 3, it will be appreciated that this need not be the case.

Figure 3:
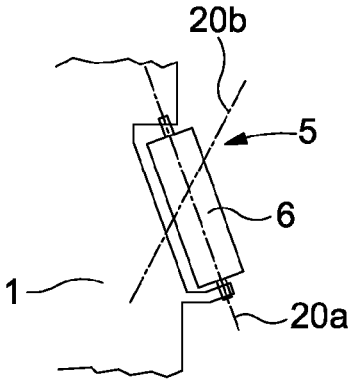
FIG. 3 is a diagram illustrating a modification.

As illustrated in FIG. 3, rather than have the rollers 6 orientated such that the axes of rotation thereof are parallel to the axis of rotation of the drill bit 10, the axes of rotation may be orientated to achieve a desired effect. For example, by arranging the rollers 6 such that their axes of rotation are tilted upwards (denoted by line 20*a* in FIG. 3), or downwards (denoted by line 20*b* in FIG. 3) such that the axes of rotation of the rollers lie upon the surface of a notional cone, the stability of the bit may be enhanced when the steering of the cutting direction is being undertaken. For example by tilting the axis down-hole, a down-hole directed force may be applied to the bit to assist in drilling ahead. In embodiments with multiple rollers at different axial positions, the up-hole rollers may be tilted down-hole while the down-hole rollers are tilted uphole.

In some embodiments at least one roller may be provided with a roller element axis perpendicular to the rotational axis of the bit 10, to help with running into and out of the borehole. Such perpendicular rollers could be used with a bent bottom hole assembly, located on a motor housing and/or on the bit, thereby reducing wear by reducing running friction.

Figure 4:
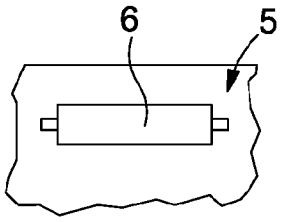
FIG. 4 is a view illustrating an alternative arrangement.

FIG. 4 illustrates an arrangement in which the axes of rotation of the rollers 6 are arranged perpendicularly to the rotational axis of the drill bit 10, as mentioned above. It is thought that in such an arrangement, resistance and wear experienced when running or tripping the drill bit into or out of the borehole may be reduced. In this arrangement, the gauge section conveniently further includes fixed gauge pads 7 to provide support and stability to the drill bit 10. Such an arrangement is thought to also result in reduced damage to the borehole wall during such tripping operations.

The effective rolling resistance of a roller 6 may be adjustable. Adjustment of the rolling resistance may be used to affect the behaviour of the bit 10, in use, such as the "walk rate" of the bit 10. The friction/rolling resistance may be adjusted to compensate for wear of the cutters 4, for instance by progressively decreasing friction/rolling resistance as the cutting elements 4 wear. The friction/rolling resistance may be adjustable to match different geologic formations.

In some embodiments a roller 6 may be actively braked by a brake or resistance mechanism. In some embodiments the brake or resistance mechanism may be operable to apply negative torque to oppose the rotation of the drill bit 10 in the cutting direction. The brake or resistance mechanism may be controllable or switchable to vary the applied torque on demand. The brake or resistance mechanism may be electrical, hydraulic or mechanical. The brake or resistance mechanism may be integral to the bit, or may be external thereto.

A roller 6 may be provided with a damping mechanism to reduce or eliminate stick slip effects. The damping mechanism may for instance provide a torque proportional to the speed of rotation of the roller element 8 and/or to the angular acceleration of the roller element 8 on the roller 6. The damping mechanism may be configured to provide non-linear damping, for instance having a triggering rate of rotation or providing an approximate limit to the rate of rotation of the roller element by steeply increasing damping from a certain rate of rotation. The damping mechanism may limit the maximum rotational speed of the drill bit 10, and/or the maximum angular acceleration thereof. In other embodiments, the triggers and/or limit damping behaviours are based, not on rate of rotation, but on angular acceleration of the roller element 8.

Rollers 6 with a damping mechanism may have a surface adapted to grip the formation. For example, the external surface of the roller element 8 may be provided with teeth that engage with the formation.

The damping mechanism may be integral to a roller 6, or may be provided by a drive means of the drill bit 10.

Figure 5:
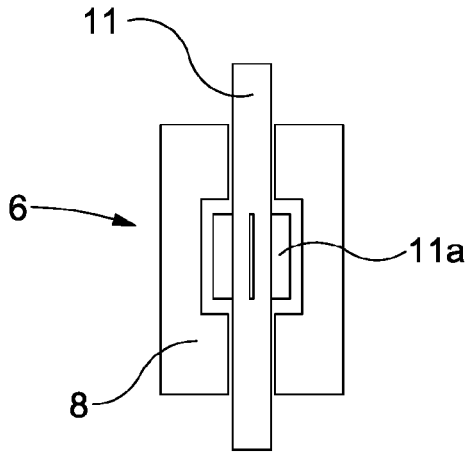
FIGS. 5 and 6 illustrate further modifications.

FIG. 5 illustrates one arrangement by which rotation of the roller 6 may be damped. In this arrangement, the roller 6 is hollow, and the shaft 11 upon which it is mounted for rotation is provided with vanes 11*a*. A viscous fluid is located within the roller 6, and the interaction between the fluid and the vanes 11*a* serves to resist or damp rotation of the roller 6. As mentioned hereinbefore, the damping may be arranged to limit the speed of rotation of the roller 6, or to damp acceleration thereof. By the use of a fluid the viscosity of which can be controlled, the level of damping provided can also be controlled. An example of a fluid having a controllable viscosity is a magneto rheological fluid.

In some embodiments rollers 6 may be positioned in different axial positions, which may be determined by aspects of the bit design in use. For example, it may be appropriate to position the rollers 6 rearward due to steering considerations. The placement and spacing of the rollers 6 may be determined by consideration of components external to the bit 10. Rollers 6 may for instance be located adjacent to the reamer on a bi-centre bit or hole opener, or at the location of the bend of a motor housing. A bi-centre bit according to an embodiment may be provided with a roller gauge, comprising at least one roller, adjacent to one or other or both of the pilot gauge and the reamer gauge.

Figure 6:
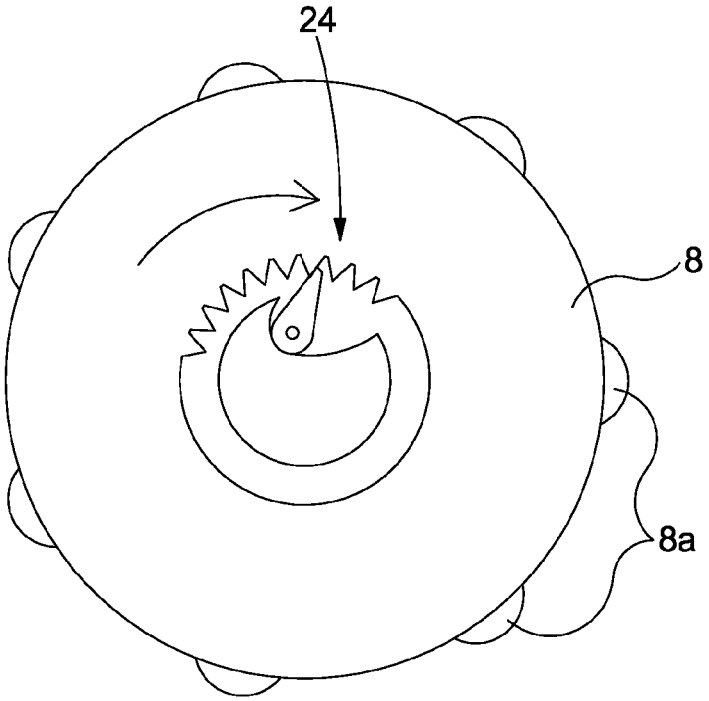

As shown in FIG. 6, one or more rollers 6 may be provided with a ratchet type mechanism 24 that only permits rotation of the roller element 8 in one direction (e.g. the cutting direction). The ratchet mechanism may be part of a drive means of the drill bit that is coupled to the roller element 8 in use. The presence of the ratchet mechanism serves to resist rearward rotary motion of the bit, thereby reducing bit whirl. It may also resist stick-slip motion.

The bit 10 may have a different number of blades 3, and may have only one blade.

The cutting elements 4 may comprise any suitable material, such as boron cubic nitride or diamond impregnated metal.

In some embodiments, the shape of the roller element 8 may vary from cylindrical, for example being tapered, elliptical or spherical.

Whilst the description hereinbefore relates primarily to drill bits, it will be appreciated that the invention is not restricted in this regard and is also applicable to other forms of downhole rotary tool in which a body includes a gauge region, at least one gauge roller being mounted to the body in the gauge region in such a manner as to engage the adjacent formation. The gauge roller and manner in which is it mounted may take any of the forms outlined hereinbefore.

The skilled person will appreciate that a number of other modifications and variations are possible, within the scope of the invention, as defined by the appended claims.

The invention claimed is:

1. A rotary downhole tool comprising a tool body defining a gauge region, and at least one gauge roller rotatably mounted to the body, wherein the at least one gauge roller has an axis of rotation which is angled to an axis of rotation of the body, in use, such that the axis of rotation of the at least one gauge roller lies upon a surface of a notional cone, wherein a damping arrangement is provided to resist acceleration of the gauge roller and/or to limit the speed of rotation of the gauge roller.

2. The tool according to claim 1, wherein the gauge region further includes at least one fixed gauge pad able to bear, in use, against the wall of a borehole.

3. The tool according to claim 2, wherein the at least one fixed gauge pad is removably mounted to the bit body.

4. The tool according to claim 3, wherein the fixed gauge pad is provided with wear resistant features.

5. The tool according to claim 1, wherein the at least one gauge roller is removably mounted to the body.

6. The tool according to claim 3, wherein the mountings of the fixed gauge pads and gauge rollers are such that the fixed gauge pads and gauge rollers can be interchanged with one another.

7. The tool according to claim 1, wherein the angling of the axis is used to enhance support when the body is tilted relative to the axis of the adjacent part of the borehole.

8. The tool according to claim 1, wherein the at least one gauge roller incorporates a ratchet whereby rotation of the gauge roller in one rotary direction is permitted, but rotation in the reverse direction is resisted.

9. The tool according to claim 1, wherein the damping arrangement comprises a viscous fluid located so as to damp rotation of the gauge roller.

10. The tool according to claim 1, wherein the damping arrangement is adjustable.

11. The tool according to claim 1, further comprising a brake or resistance mechanism wherein the gauge roller is able to be braked.

12. The tool according to claim 1, wherein the gauge roller incorporates an internal bearing.

13. The tool according to claim 12, wherein the internal bearing comprises a diamond material coated surface.

14. The tool according to claim 12, wherein the internal bearing incorporates seal means to retain a lubricant within the internal bearing.

15. The tool according to claim 12, wherein the internal bearing comprises a thrust bearing.

16. The tool according to claim 1, wherein the gauge roller is provided with teeth or other engagement features.

17. The tool according to claim 16, wherein the teeth or engagement features are arranged such that the effective outer diameter of the gauge roller is substantially uniform.

18. The tool according to claim 1, wherein the gauge roller is secured to the body in such a fashion that the axis of rotation of the gauge roller is adjustable relative to the body.

19. The tool according to claim 18, wherein the gauge roller is resiliently mounted to the body.

20. The tool according to claim 18, further comprising adjustment means operable to adjust the position of the axis of the gauge roller relative to the body.

21. The tool according to claim 20, wherein the adjustment means is controllable or switchable whilst the tool is located downhole.

22. The tool according to claim 1, wherein the tool comprises a drill bit, the body comprising a bit body upon which is mounted a plurality of cutting elements, the greatest diameter at which one of the cutting elements engages the formation defining a cutting diameter.

23. The tool according to claim 22, wherein a gauge diameter defined by the diameter at which the gauge roller engages the formation is substantially equal to the cutting diameter.

24. The tool according to claim 22, wherein a gauge diameter defined by the diameter at which the gauge roller engages the formation is greater than the cutting diameter.

25. A rotary downhole tool comprising:

a tool body defining a gauge region;

at least one gauge roller rotatably mounted to the body, wherein the at least one gauge roller has an axis of rotation which is angled to an axis of rotation of the body, in use, such that the axis of rotation of the at least one gauge roller lies upon a surface of a notional cone; and a damping arrangement provided to resist acceleration of the gauge roller and/or to limit the speed of rotation thereof, wherein the damping arrangement comprises a viscous fluid located so as to damp rotation of the gauge roller, wherein the viscous fluid is of controllable viscosity.

26. The tool according to claim 25, wherein the viscous fluid is a magneto rheological fluid.

* * * * *